US005881486A

United States Patent [19]

Bilgeri et al.

[11] Patent Number: 5,881,486

[45] Date of Patent: Mar. 16, 1999

[54] HAND-HELD FIREARM WITH A LIGHT CASING

[75] Inventors: Elmar Bilgeri; Ulrich Zedrosser, both of Steyr, Austria

[73] Assignee: Steyr-Daimler-Puch Aktiengesellschaft, Vienna, Austria

[21] Appl. No.: 925,258

[22] Filed: Sep. 8, 1997

[30] Foreign Application Priority Data

Sep. 10, 1996 [AT] Austria ..... 1600/96

[51] Int. Cl.[6] ..... F41A 21/48

[52] U.S. Cl. ..... 42/75.02; 42/101

[58] Field of Search ..... 42/75.01, 75.02, 42/101

[56] References Cited

U.S. PATENT DOCUMENTS

| | | | |
|---|---|---|---|
| 2,795,881 | 6/1957 | Bellows | 42/75.01 |
| 3,611,611 | 10/1971 | Quinney | 42/75.02 |
| 3,939,589 | 2/1976 | Tellie . | |
| 4,291,476 | 9/1981 | Repa | 42/101 |
| 4,860,480 | 8/1989 | Ruger | 42/101 |
| 4,944,109 | 7/1990 | Zedrosser | 42/75.01 |
| 5,020,260 | 6/1991 | Houghton | 42/75.02 |
| 5,142,806 | 9/1992 | Swan | 42/101 |
| 5,343,650 | 9/1994 | Swan | 42/75.01 |

FOREIGN PATENT DOCUMENTS

| | | | |
|---|---|---|---|
| 704640 | 4/1941 | Germany | 42/75.02 |
| 43270 | 11/1965 | Germany | 42/75.01 |
| 4107675 | 9/1992 | Germany | 42/75.02 |
| 9320398 | 10/1993 | WIPO | 42/75.01 |

*Primary Examiner*—Stephen M. Johnson
*Attorney, Agent, or Firm*—Bachman & LaPointe, P.C.

[57] ABSTRACT

A hand-held firearm, comprising a casing which accommodates breech parts, a stock which is attached to the casing, and a barrel which is detachably connected to the casing, and having a mounting for a telescopic sight. In order to avoid the disadvantages of the conventional telescopic sight fitting and to allow the entire weapon to have a neat and practical shape, the casing forms a casing extension at the front beyond the connection to the barrel and a longitudinal rail is integrally formed at the top on the casing and on the casing extension as a mounting for the telescopic sight. The casing parts are made of light metal alloy.

9 Claims, 4 Drawing Sheets

HAND-HELD FIREARM WITH A LIGHT CASING

BACKGROUND OF THE INVENTION

The present invention relates to a hand-held firearm, comprising a casing which accommodates breech parts, a stock which is attached to the casing, and a barrel which is detachably connected to the casing, and having a mounting for a telescopic sight.

Telescopic sights are normally attached to specific points on the weapon by means of adjustable brackets, at least one of which is attached to the barrel, because of the length of the telescopic sight. This direct connection of the barrel and the telescopic sight leads on the one hand to vibration and maladjustment of the telescopic sight while, on the other hand, the asymmetric large mass created by the connecting element has an adverse effect on the vibration behavior of the barrel, and thus on the aiming accuracy.

Nowadays, telescopic sights are being used whose reticle is further away from the eye of the person shooting, or even more complex aiming devices, some of which are even electronic. These devices are generally attached to the barrel by both brackets and, in consequence, the above disadvantages occur even more severely. Further disadvantages of the known arrangement are the large distance from the barrel axis and the lack of any adjustment capability in the longitudinal direction.

It is the principle object of the present invention to create a rifle which avoids the foregoing disadvantages of conventional telescopic sight fitting and allows the entire weapon to be designed cost-effectively and nevertheless to have a neat and practical shape.

SUMMARY OF THE INVENTION

The foregoing object is achieved according to the present invention, wherein the casing has a casing extension at the front beyond the connection to the barrel, and a longitudinal rail is integrally formed on the top of the casing and on the casing extension as a mounting for the telescopic sight.

The casing extension and its longitudinal rail thus form the base for the telescopic sight to be fitted. As a result of the fact that the longitudinal rail is integrally formed directly on the casing, the optical axis of the telescopic sight is very close to the barrel axis. In addition, as a result of the fact that the longitudinal rail extends virtually over the entire length of the casing and the casing extension, a very wide range of telescopic sights can be mounted at different distances from the eye without having to touch the barrel. Furthermore, the casing extension provides effective hand protection, gives greater freedom in the choice of materials and, overall, allows the weapon to be designed particularly cost-effectively and practically. Finally, the longitudinal rail increases the casing stiffness.

A preferred material for the casing is light alloy, particularly if the casing is manufactured from an extruded profile. This not only results in the additional weight being more than compensated for as a result of the casing extension and a telescopic sight being shifted forward, but also achieves a considerable reduction in cost. This relates particularly to an extruded profile. A further simplification in manufacture is achieved if the casing comprises a plurality of bonded parts, one of which is the casing extension. In this case, a largely cylindrical bonded joint can be achieved, which improves the strength of the connection.

The bending strength of the casing and casing extension is increased by their cross section being extended laterally on both sides above the horizontal center plane and roughly forms a step therein. A fore-end or a casing shell can, in addition, be connected flush to the step, also sealing the casing at the front such that it is dust proof.

In a particularly advantageous embodiment, the longitudinal rail has a dovetail profile on which two clamps are guided which hold the telescopic sight. This allows the optical axis of the telescopic sight to be positioned even closer to the barrel axis, particularly if the longitudinal rail has grooves in the transverse direction at specific intervals. These grooves offer space for the clamping screws which fix the clamp.

BRIEF DESCRIPTION OF THE DRAWINGS

The invention is described in the following text with reference to figures, in which.

DETAILED DESCRIPTION OF THE PREFERRED EMBODIMENT(S)

Figure 1:
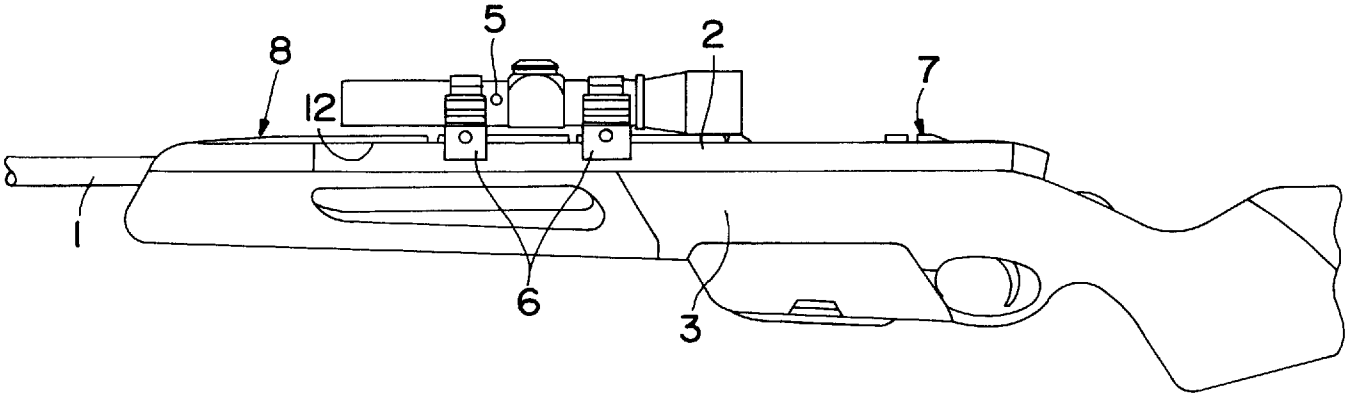
FIG. 1 shows a side view of a rifle according to the invention.
Figure 2:
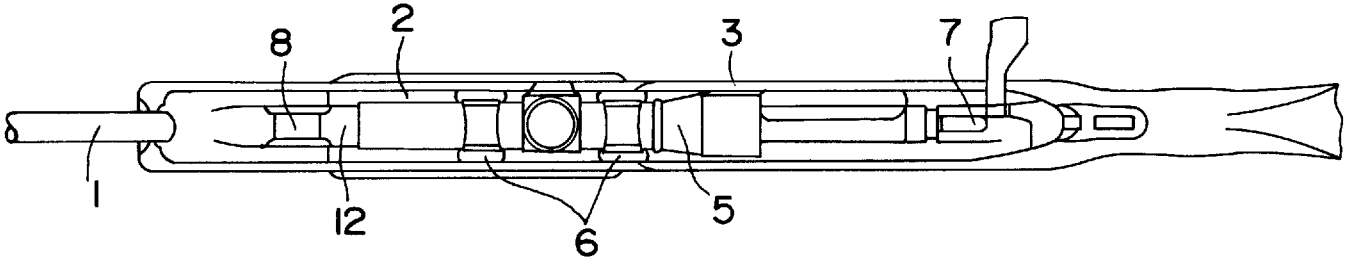
FIG. 2 shows a plan view of the same.

FIGS. 1 and 2 show the major parts of a rifle, the casing 2, the (cut-off) barrel 1 and the stock 3, with the rear part cut off. The casing 2 has a longitudinal rail 12 on the top for fitting a telescopic sight 5 by means of clamps 6. The actual sights 7, 8, the rear sight and the front sight, cannot be seen since they are folded in, and are indicated only by arrows.

Figure 3A:
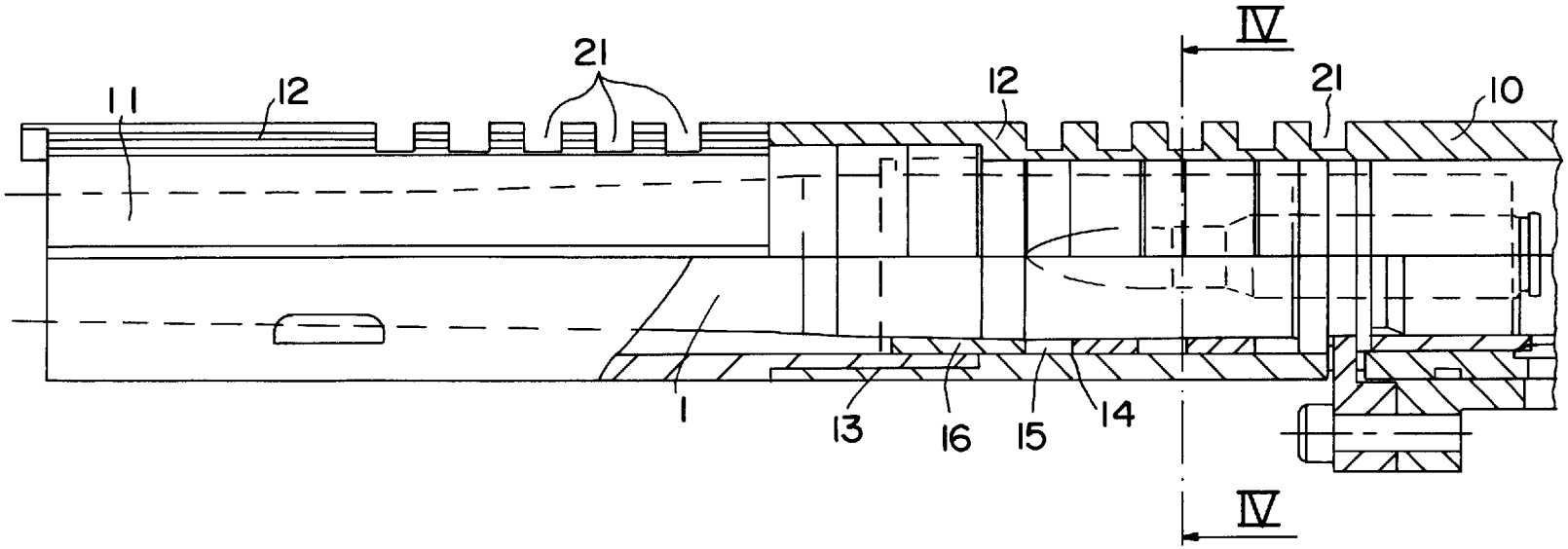
FIGS. 3A and 3B show a partial vertical section on a larger scale.
Figure 3B:
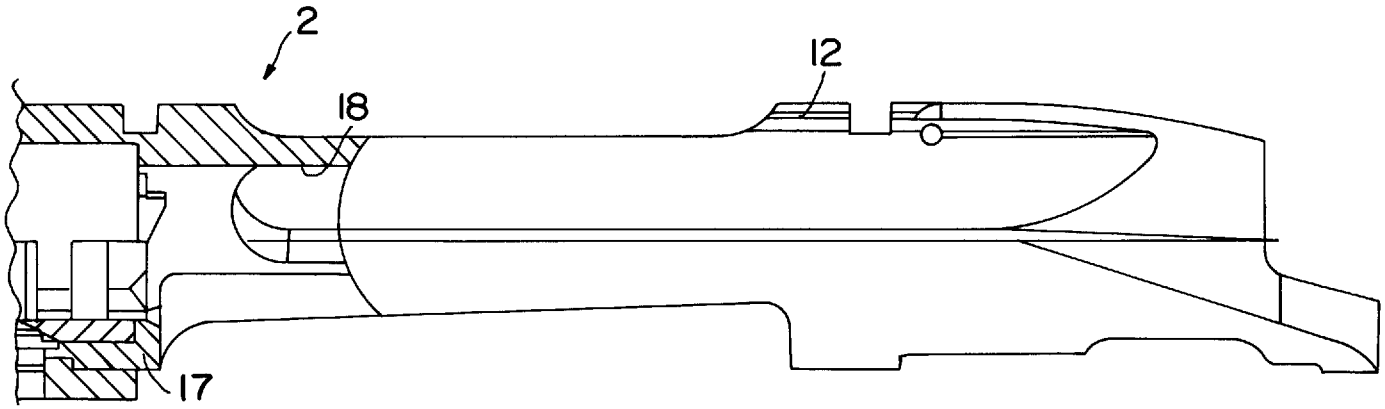

FIGS. 3A and 3B show that the casing 2 comprises a casing body 10 and a casing extension 11. Both parts are made of metal, may be extruded profiles and may be bonded to one another. The corresponding bonded joint 13 is mainly located cylindrically, for a firm connection. The two profiles have parts of a longitudinal rail 12 which are aligned with one another. A barrel connection 14 is provided in the casing body 10, behind the bonded joint 13. In the case of a casing made of light alloy, it is advantageously formed by conical rings 15 and a tightening nut 16, which can be tightened against the barrel. Behind this barrel connection 14, the casing body 10 is fitted with a locking sleeve 17, on which a guide 18 is provided at the rear, for a breech (which is not illustrated).

Figure 4:
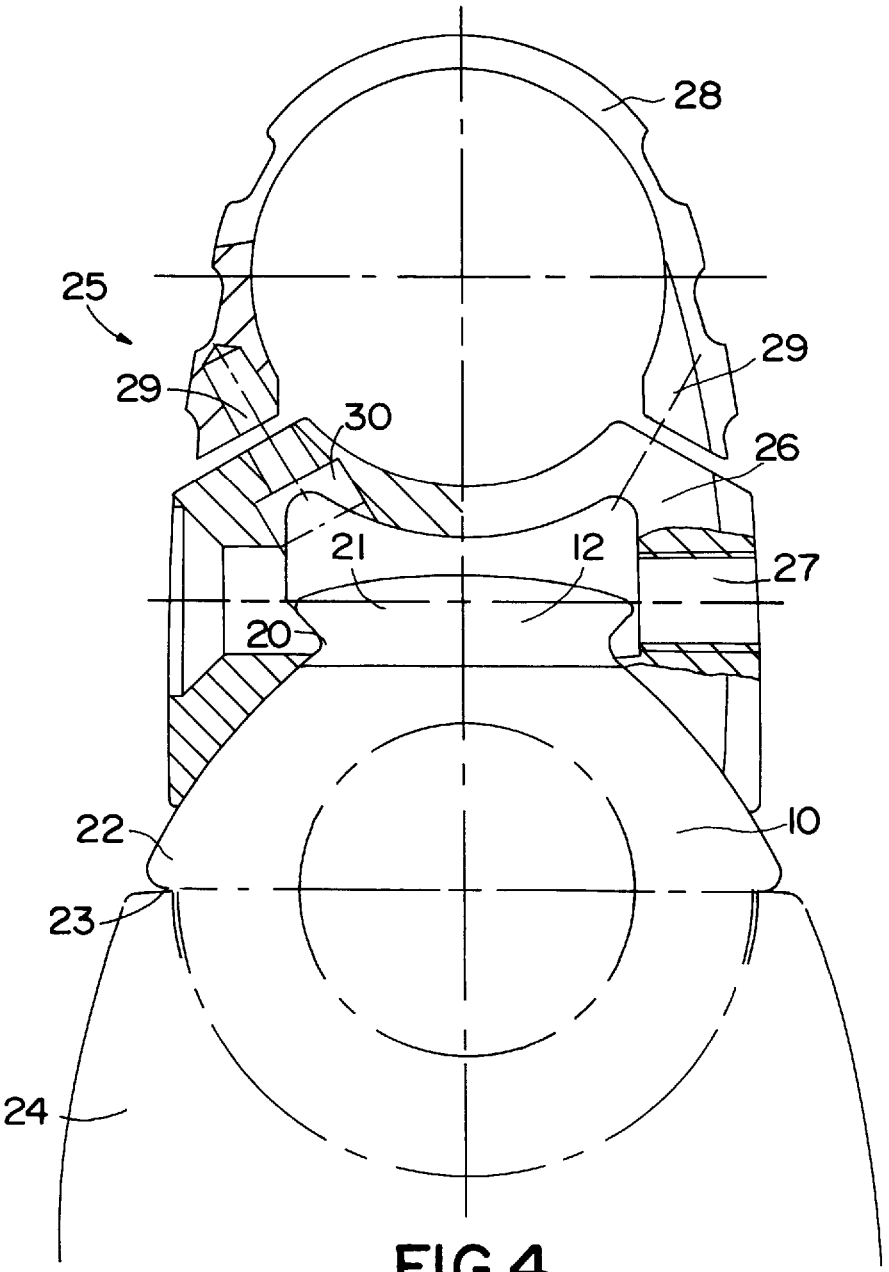
FIG. 4 shows a section along IV—IV in FIG. 3A on an even larger scale.

In the cross section in FIG. 4, the longitudinal rail 12, which runs over the casing body 10 and the casing extension 11, can be seen, together with the transverse grooves 21, in more detail. The profile of the casing body 10 and the casing extension 11 furthermore has, in their two upper quadrants, an extension 22 which ends in a step 23, pointing inward, on both sides. This ensures a smooth transition between the casing and the stock 24, which is only indicated here, and may also comprise two half shells. This step is also used for accurate positioning of the casing in the stock. A clamp 25, which comprises a base body 26 and a clamp bracket 28, is provided on the dovetail grooves 20 on both sides of longitudinal rail 12, for attachment of a telescopic sight. The base body 26 is guided in the dovetail groove 20 and has a threaded hole 27 for a countersunk bolt, which is not illustrated. The clamp bracket 28 has a hole 29 on each side for a bolt, which is likewise not illustrated and for whose head a recess 30 is provided in the clamp base body; it is thus not visible from the outside.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hand-held firearm comprising: a casing containing breech parts; a stock attached to the casing; a barrel detachably connected to the casing at a first point; a telescopic sight mounted on the casing, said casing comprises a casing body having a front end and a casing extension having a rear end and a front end said rear end being connected to the front end of the casing body by means of a joint at a second point between the said first point and the front end of the casing; a longitudinal rail located on said casing body and said casing extension wherein said longitudinal rail extends substantially over the entire length of the casing and including the casing extension; and means associated with said longitudinal rail for mounting the telescopic sight thereon.

2. The hand-held firearm as claimed in claim 1, wherein the casing body and the casing extension are formed of metal alloys.

3. The hand-held firearm as claimed in claim 2, wherein the casing body and the casing extension are extruded profiles.

4. The hand-held firearm as claimed in claim 1, wherein the majority of the joint is substantially cylindrical.

5. The hand-held firearm as claimed in claim 1, wherein the casing extension has a horizontal center plane and is provided with lateral extensions on opposed sides thereof above the horizontal center plane to form a pair of steps thereon.

6. The hand-held firearm as claimed in claim 5, wherein said lateral extensions form with said pair of steps a smooth transition between the casing and the stock.

7. The hand-held firearm as claimed in claim 1, wherein the longitudinal rail is provided with a dovetail profile for receiving said means for mounting the telescopic sight.

8. The hand-held firearm as claimed in claim 7, wherein the longitudinal rail is provided with a plurality of transverse grooves at specific intervals.

9. The hand-held firearm as claimed in claim 7, wherein said means for mounting comprises at least two clamps guided in said dovetail profile.

* * * * *